US006224940B1

(12) United States Patent
Karlsson et al.

(10) Patent No.: US 6,224,940 B1
(45) Date of Patent: May 1, 2001

(54) METHOD AND APPARATUS FOR COATING SLEEVES AND PRODUCTS COMPRISING SUCH SLEEVES

(75) Inventors: Ulf Karlsson, Filipstad; Sören Sjöholm, Lesjöfors, both of (SE)

(73) Assignee: ULF Karlsson (SE)

( * ) Notice: Subject to any disclaimer, the term of this patent is extended or adjusted under 35 U.S.C. 154(b) by 0 days.

(21) Appl. No.: 09/284,861

(22) PCT Filed: Sep. 8, 1997

(86) PCT No.: PCT/SE97/01500

§ 371 Date: Apr. 22, 1999

§ 102(e) Date: Apr. 22, 1999

(87) PCT Pub. No.: WO98/18566

PCT Pub. Date: May 7, 1998

(30) Foreign Application Priority Data

Oct. 29, 1996 (SE) ..... 9603943

(51) Int. Cl.[7] ..... B05D 1/26; B05D 1/30

(52) U.S. Cl. ..... 427/232; 427/230; 427/235; 427/238; 118/408; 118/409; 118/410; 118/503

(58) Field of Search ..... 427/230, 232, 427/235, 238; 118/317, 318, 215, 501, 503, 505, 408, 409, 410

(56) References Cited

U.S. PATENT DOCUMENTS

| | | | | |
|---|---|---|---|---|
| 4,101,623 | | 7/1978 | Webster et al. | 264/270 |
| 4,107,254 | | 8/1978 | Webster et al. | 264/270 |
| 4,496,502 | * | 1/1985 | Kutowy et al. | 427/230 |
| 5,141,774 | * | 8/1992 | Prittinen et al. | 427/236 |
| 5,456,940 | * | 10/1995 | Funderburk | 427/236 |
| 5,855,676 | * | 1/1999 | Lu et al. | 118/317 |

FOREIGN PATENT DOCUMENTS

| | | |
|---|---|---|
| 26 36 203 A1 | 8/1976 | (DE) . |
| 40 25 199 A1 | 8/1990 | (DE) . |
| 0 400 567 A2 | 5/1990 | (EP) . |
| 0 466 147 A1 | 7/1991 | (EP) . |

OTHER PUBLICATIONS

"Apparatus for Coating Inner Surface of Cylinder", Translation of Japanese Patent Abstract, Appl. No. 61–175152, filed Jul. 25, 1986.

International Search Report for PCT/SE 97/01500, dated Dec. 17, 1997.

* cited by examiner

*Primary Examiner*—Shrive Beck
*Assistant Examiner*—Kirsten A. Crockford
(74) *Attorney, Agent, or Firm*—Kilpatrick Stockton LLP

(57) ABSTRACT

The present invention relates to a method and device for manufacturing coated sleeves, whereby the sleeve is positioned vertically and held stationary, while a feed pipe is introduced from below, by vertical displacement, concentrically into the sleeve. Also from below, an excess of fluid is supplied under pressure, through the feed pipe. The fluid is allowed to emanate from an upper end outlet of the feed pipe and allowed to flow by gravity in the small gap which is formed between the feed pipe and the internal walls of the sleeve. The internal walls of the sleeve are thereby coated with the fluid, while at the same time, the coating of the outside of the sleeve is prevented. The invention also relates to a writing pen comprising a coated sleeve.

17 Claims, 6 Drawing Sheets

METHOD AND APPARATUS FOR COATING SLEEVES AND PRODUCTS COMPRISING SUCH SLEEVES

TECHNICAL FIELD

The present invention relates to a method of manufacturing coated sleeves, a device for its execution and products comprising sleeves coated according to the present method.

BACKGROUND OF THE INVENTION

Many office and writing products, food packaging etc are manufactured from plastic or metal or combinations of these materials. With the increase in environmental awareness over a number of years, there is a desire to be able to use instead renewable raw material containing for example cellulose, such as cardboard and paper, for example in pens, sleeves for glue sticks, containers for correction fluid, sleeves for various foodstuffs etc. One problem, however, is that cardboard absorbs and/or lets through liquid if it is not protected against the liquid or treated in a suitable manner. It is relatively common to provide pens for example with an outer sleeve of cardboard, in which however the inner ink container is still of plastic or metal. To the eye this perhaps appears to be environmentally friendly, but is not so in practice. Other attempts have been made to utilize cardboard or paper by coating a sheet of paper with a liquid-proofing plastic layer, the sheet then being wound round several turns in the form of a sleeve, so that a cylindrical space is formed. A disadvantage of this method is that the material in the sleeve becomes impossible to recycle. It would in fact also be possible to dip a cardboard tube into a fluid, which on drying/solidifying produced a liquid-proofing film. The problem then is that it is difficult to apply text and other print to the outside of the sleeve. As far as the inventor knows, no method has been developed for the manufacture of cardboard sleeves or similar items which are coated on the inside only with a liquid-proofing film of a type other than plastic.

BRIEF DESCRIPTION OF THE INVENTION

The object of the present invention is to remedy the above complex problems and provide sleeves of renewable raw materials such as cardboard, coated with a liquid-proofing film on the inside which is not composed of plastic or metal, intended to be capable of being used in marker pens, glue sticks and other similar office and writing products and as food packaging.

This object is achieved according to an aspect of the invention by a method and a device characterized by the characterizing part of the claims.

BRIEF DESCRIPTION OF THE DRAWINGS

In the following description of a preferred embodiment, reference will be made to the enclosed drawings, of which

DESCRIPTION OF PREFERRED EMBODIMENT

Figure 1:
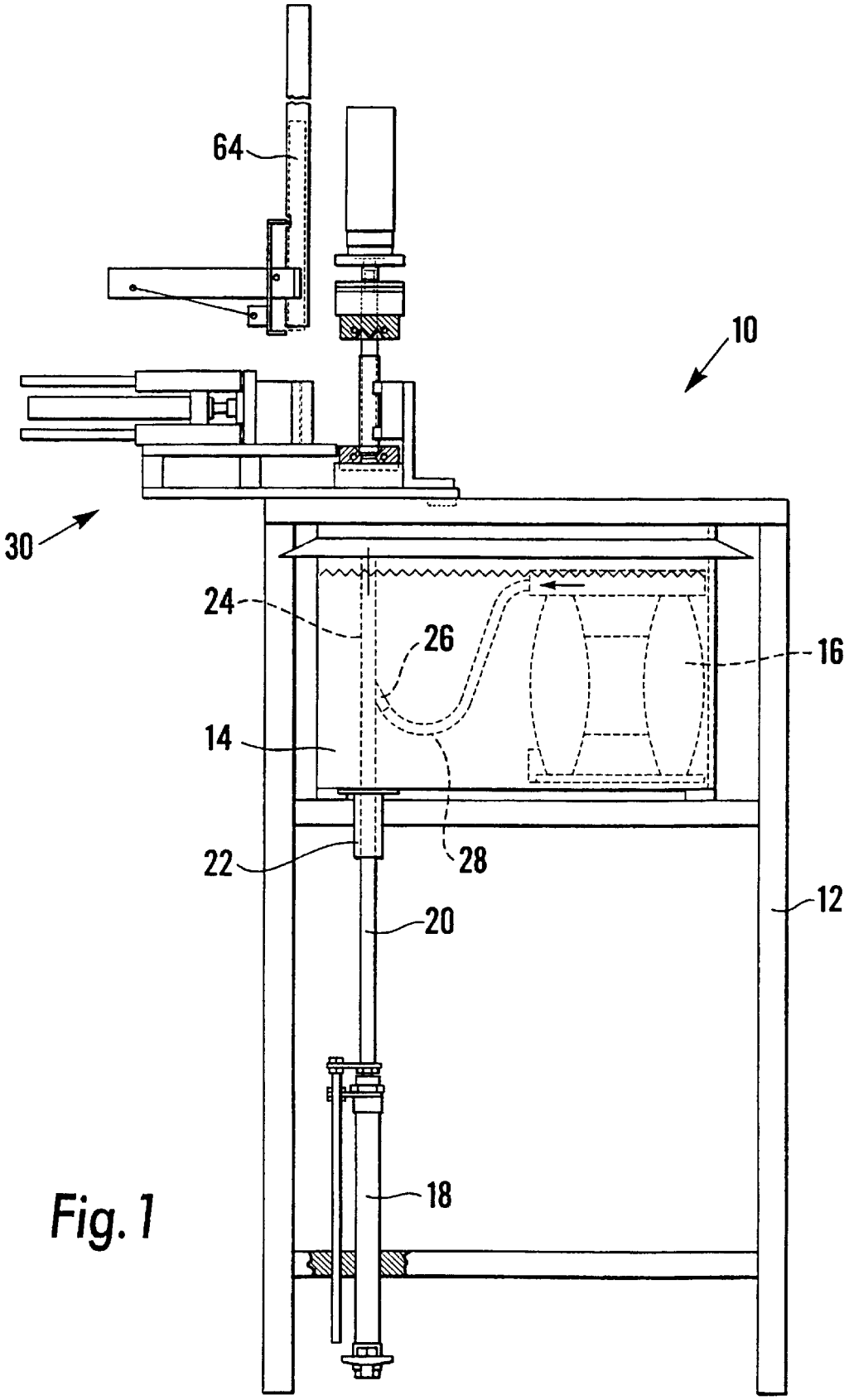
FIG. 1 shows a sectional view of the device for coating sleeves according to the invention.
Figure 2:
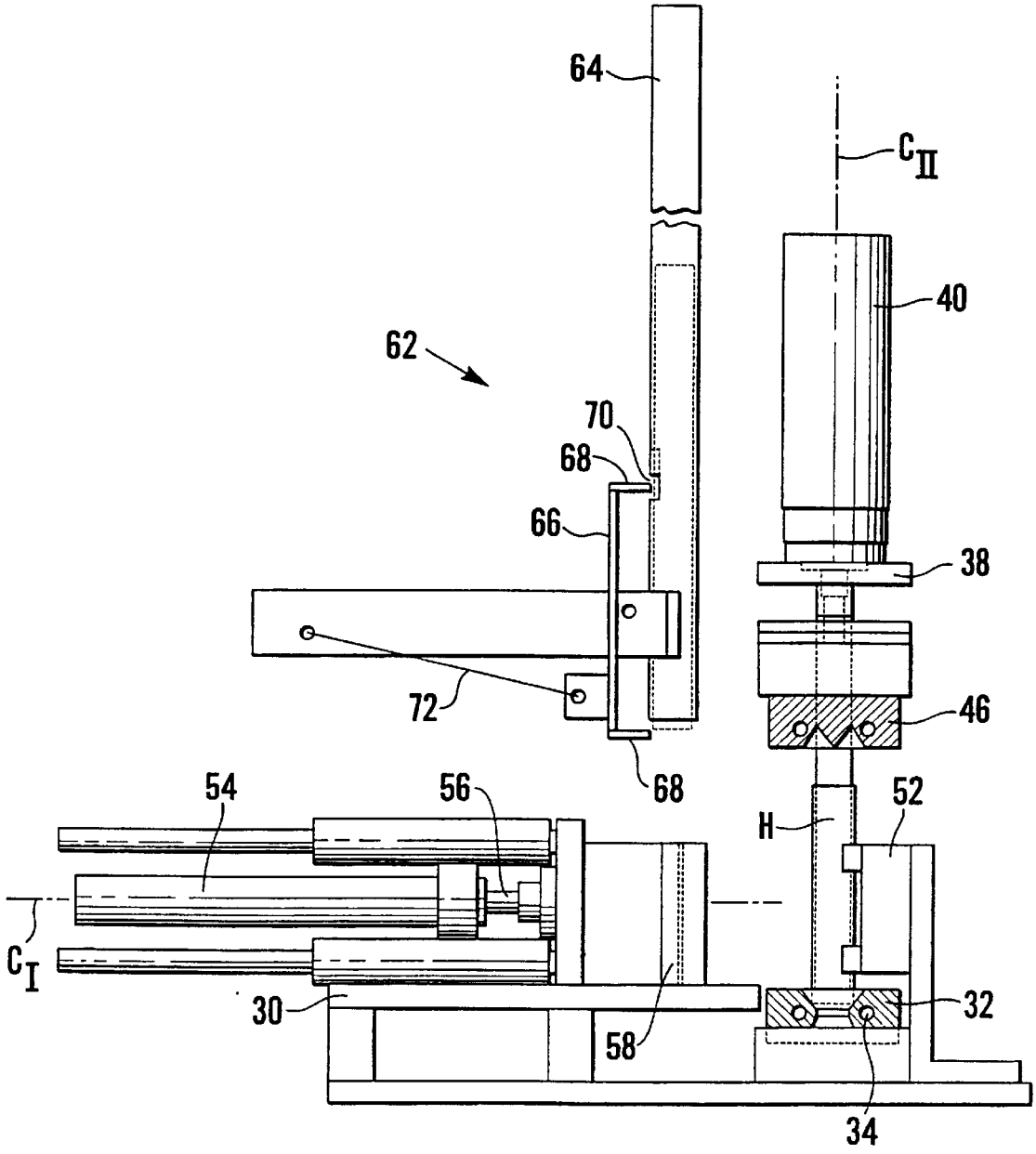
FIG. 2 shows a partial view of the device according to FIG. 1 from the side.

The device according to the invention which is shown in the drawings generally has the reference number 10. The device comprises a stand or frame 12. Disposes in the frame is a tank or container 14, which is filled to a certain level with a coating fluid. Disposed in the tank 14 are a pump 16 and a heating device, for example heating coils with hot water. A cylinder 18 is fitted under the tank 14 and oriented vertically. The piston rod 20 of the cylinder 18 runs through a bushing 22 into the tank and a distance into the tank, the bushing 22 being fitted with suitable seals. Affixed to the piston rod 20 at its end is a pipe 24, henceforth called the feed pipe, which pipe runs concentric to the piston rod 20. Fitted to the lower part of the feed pipe is a pipe connection 26, which communicates via a flexible hose 28 with the outlet of the pump 16. The length of the feed pipe 24 and the stroke length of the cylinder 18 are matched so that the upper end of the pipe 24 is positioned at a distance under the surface of the fluid when the piston 20 is in its lower end position and the upper end of the pipe 24 is positioned at a distance above the upper edge of the tank when the piston 20 is in its upper end position. The function and length adjustment of the device will be described in detail below.

Figure 4:
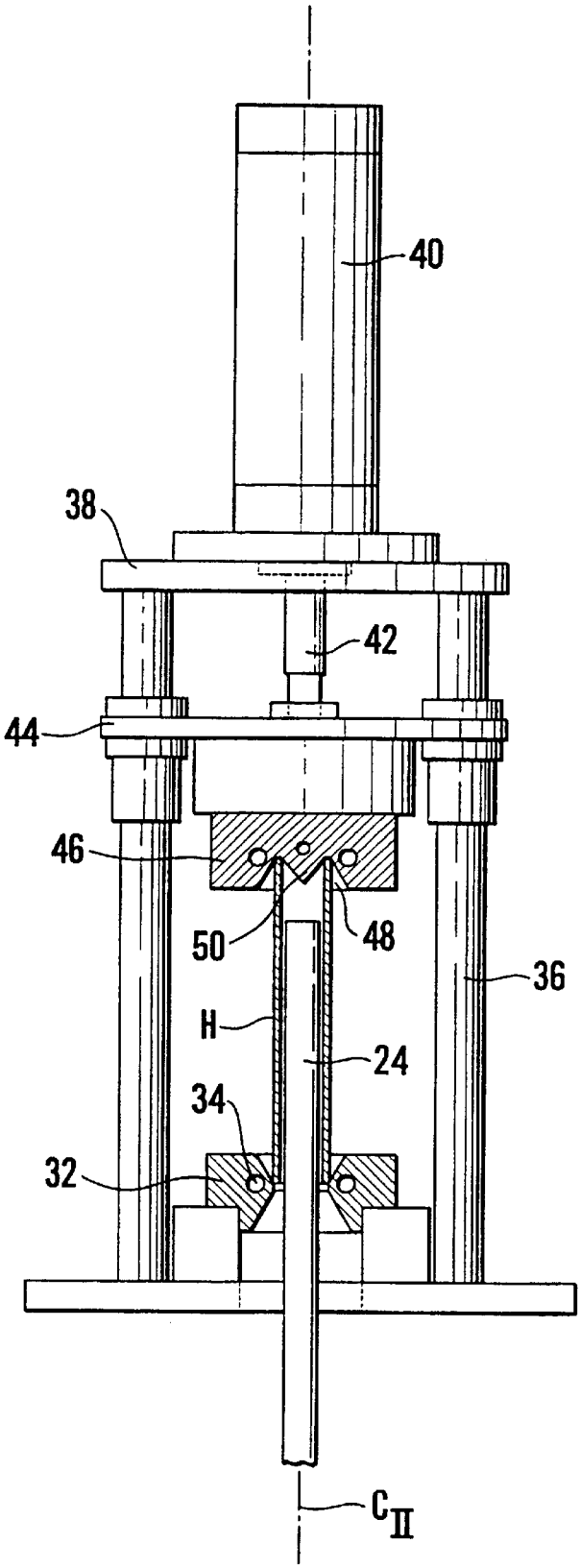
FIG. 4 shows a detailed view of the coating of sleeves on the inside.
Figure 5:
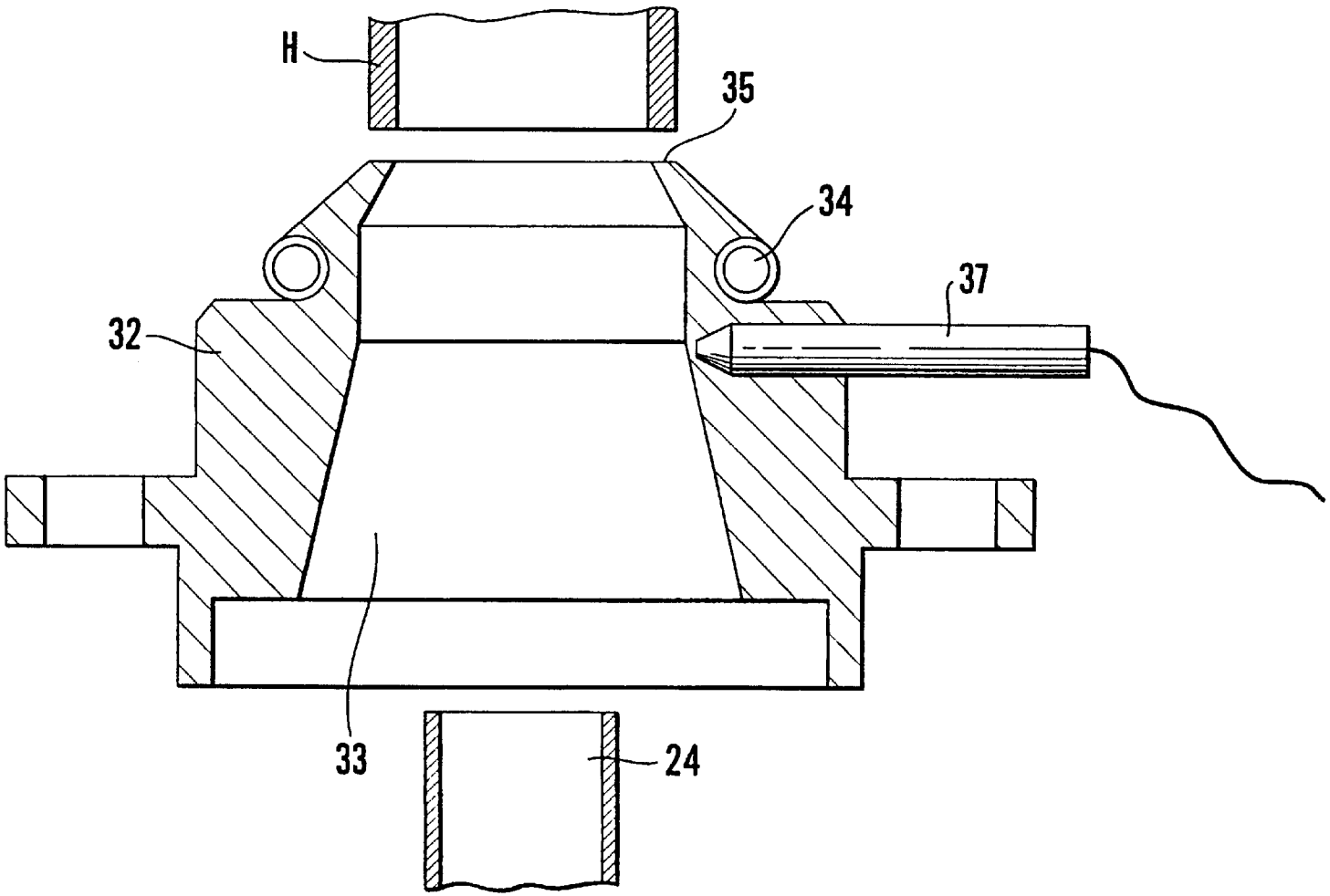
FIG. 5 shows a detailed cut away view from the side of a lower holding device forming part of the device according to FIG. 1.

Arranged on the top side of the stand is a holding device 30. On this, a lower holding device 32 in the form of a ring with a through passage 33 is arranged concentrically to the feed pipe 24, the diameter of which ring is somewhat larger than the diameter of the pipe, FIG. 5. The passage of the ring is formed tapering seen from below and with a level upper side 35. The ring 32 is also equipped with channels 34 or recesses for heating coils, cooling coils or the like for heating, cooling or maintaining the ring at a constant temperature. The ring is preferably also equipped with a temperature sensor 37. Fitted to the holding device are two guides 36, FIG. 4, in the form of two shafts, which guides are directed vertically upwards and run parallel to the feed pipe 24. Attached to the upper ends of the guides 36 is a bracket 38. Arranged on the bracket 38 is a cylinder 40, the piston rod 42 of which is directed vertically downwards and is concentric to the feed pipe 24. A second bracket 44 is arranged on the end of the piston rod 42, which bracket 44 is disposed slidably in relation to the guides 36. Affixed to the second bracket 44 is a sealing device 46. The sealing device 46 is formed with a space 48 open downwards with a circular edge and tapering when seen from the edge, the side walls of the space 48 sloping in somewhat towards the middle of the space, where they pass into an outwardly directed elevation 50.

Arranged on the holding device 30 and closely adjacent to the ring 32 is a fixing device 52. In the embodiment shown, the fixing device 52 is formed as a vertical V-block. A horizontally oriented cylinder 54 is disposed on the holding device on the opposite side to the fixing device 52 as seen from the ring 32. Fitted to the end of the piston 56 of the cylinder 54 is a pushing device 58 in the form of a vertical V-block in the embodiment shown. The piston rod 56 of the cylinder is directed towards the support and its centre axis $C_I$ cuts the centre line $C_{II}$ which runs perpendicularly through the pipe and the ring. The cylinder 54 has a stroke length such that the pushing device 58 can be oriented and immediately in front of/above the ring 32. A supporting device 60, FIG. 3, in the form of a spring wire is fitted to the holding device 30. The spring wire 60 extends in front of the pushing device 58. Arranged above the pushing device 58, when this is in its rearmost position and the rearmost position of the piston rod, is a feed device 62. In the embodiment shown this comprises a vertical pipe 64. The upper end of the pipe is suitably connected to a magazine, which is not shown. The feed device also comprises a vertical arm 66, referred to below as a tilting arm, which is affixed pivotedly at its centre. Disposed in the ends of the tilting arm 66 are two heels 68, where the upper heel can extend via an opening 70 in the pipe into this and the lower heel can extend below and in front of the end of the feed pipe. A pneumatic cylinder 72 is disposed at one end of the tilting arm 66.

Figure 3:
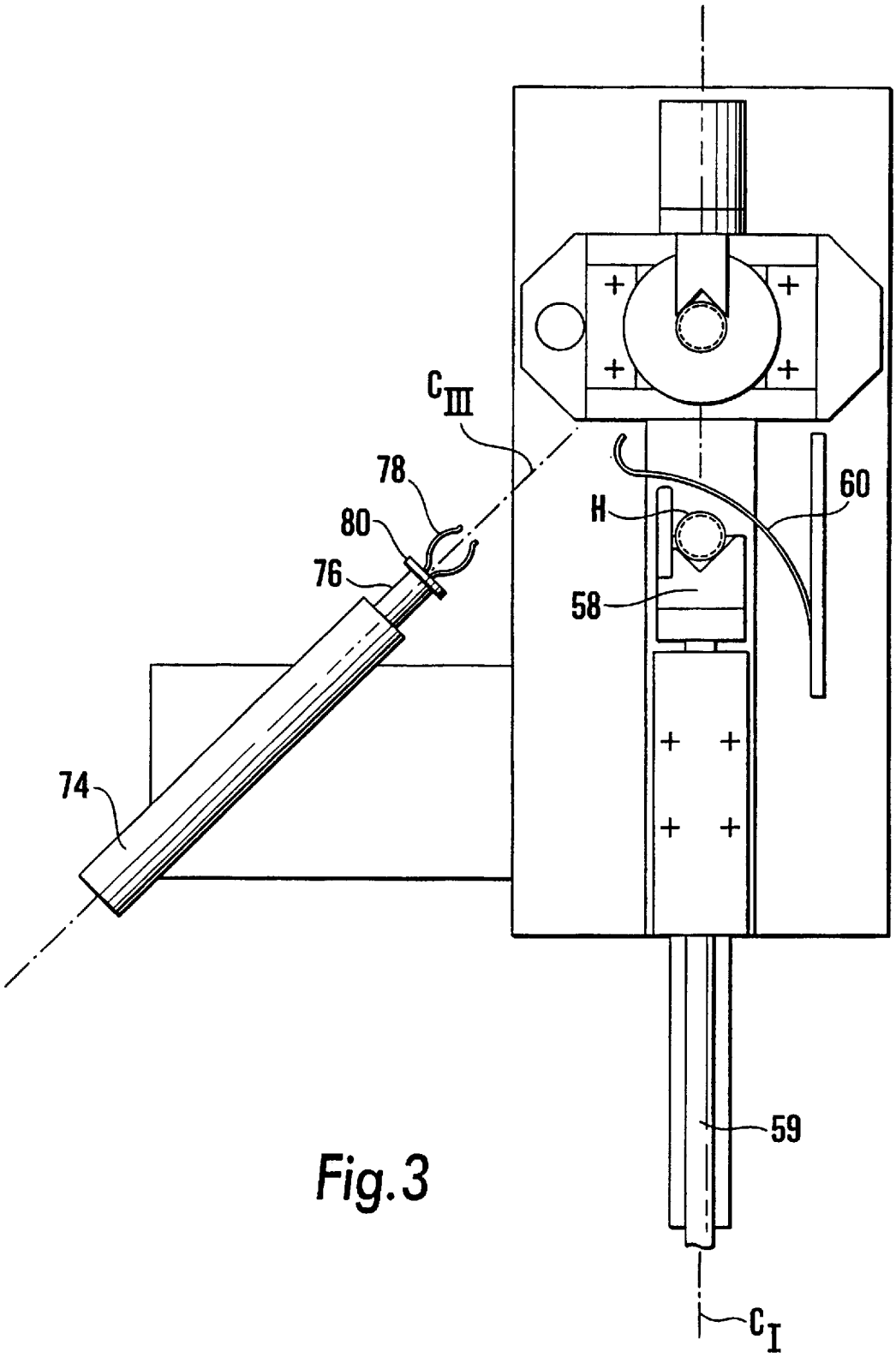
FIG. 3 shows a partial view of the device according to FIG. 1 from above.

A second, horizontally oriented cylinder 74, FIG. 3, with a piston rod 76 is also arranged on the holding device. The cylinder 74 is positioned so that the centre line $C_{III}$ of the piston rod cuts the centre line of the ring 32. A gripping device 78 is fitted to the end of the piston rod 76. Affixed to the gripping device 78 is a turning device 80, which facilitates turning of the gripping device 180° around the piston rod centre line. The cylinder 74 has a stroke length such that the gripping device 78 can be conveyed up to and above the ring. A discharge station is arranged by the side of the holding device. All cylinders include are connected to an air source and fitted with suitable breakers and contacts for control of the cylinders. The entire device is controlled by a suitable control system of a conventional nature, which will not be described in further detail.

The device functions as follows. The tank 14 is filled with a suitable fluid with which the sleeves are to be coated on the inside, and if required the heating device in the tank is activated depending on the type of fluid. The magazine and feed pipe 64 are filled with sleeves H, with the lowest sleeve lying close to the lower heel 68 of the tilting arm. The ring 32 and the sealing device 46 are heated, cooled or temperature-controlled all as required. When the device is activated, a signal is first given to the pneumatic cylinder 72, which controls the tilting arm 66, at which this is turned a little around its axis of rotation. The lower heel 68 is then moved away from the feed pipe 64 and lets a sleeve drop down at the same time as the upper heel is carried into the pipe and prevents further sleeves from tumbling down. A short time later, the cylinder is deactivated and the tilting arm resumes its original position with the lower heel in the pipe, thanks to the tension spring 72. The sleeve which was stopped previously then drops down on the heel to await the next cycle. The sleeve which has been released falls down towards the table of the holding device 30 and ends up in front of the pushing device V-block 58, which is in its rearmost position. The sleeve is prevented from falling over by the spring wire 60 of the supporting device. The pushing device is then activated and pushes the sleeve towards the V-block of the fixing device 52, at which the lower part of the sleeve is arranged concentrically on the level top side 35 of the ring 32. The cylinder 40 for the sealing device 46 is then activated, which moves down and bears on the upper edge of the sleeve with its tapered space, FIG. 4. Following this, the cylinder 18 for the feed pipe 24 and the pump 16 in the tank is activated. The feed pipe 24 is now pushed up through the ring 32 and up into the sleeve at the same time as the pump pumps the fluid up through the pipe 24 and through the pipe opening, and further up towards the sealing device 46. Due to the shape of the sealing device 46 with the point 50 directed downwards in the centre, the fluid is made to flow out from the centre of the sealing device 46 towards the edges on the sealing device and the sleeve. The feed pipe 24 is formed with a diameter which is somewhat smaller thank the inner diameter of the sleeve, so that a gap is formed between the sleeve H and the pipe 24 and the excess fluid flows down there while covering the inside of the sleeve and finally through the ring and back to the tank. When the pipe has reached almost up to the sealing device 46, the pump is stopped and the pipe is retracted, at which the remaining quantity of superfluous fluid runs down into the tank. A certain period now ensues when the sleeve is held in this position to permit some degree of drying/solidification of the fluid. During the entire period in which the fluid is supplied, and during the entire drainage time, the ring 32 and the sealing device 46 prevent the fluid from passing or even coming into contact with the edges of the sleeve, to which contamination of the outside of the sleeve with fluid is also prevented.

The cylinder 74 with the gripping device 78 than moves in and grips the sleeve at the same time as the cylinder 40 of the sealing device 46 lifts this a short distance. The gripping device 78 draws the sleeve out a short distance and turns this 180° around a horizontal axis and holds the sleeve in this position for a certain period longer. This operation is carried out so that the fluid shall not collect during drying/solidification in the lower part of the sleeve and solidify there to form an annular edge on the inside of the sleeve's lower edge. When the drying time is finished, the griping device removes the sleeve and releases it in a suitable position for further treatment. Then a new cycle begins in that a new sleeve is let down from the feed tube 64.

The fluid which is deposited on the inside can be of various conceivable types such as wax, paraffin or mixtures of these, water-based lacquer or similar. The important thing in this respect is that the fluid gives rise to a diffusion-proof film on the inside of the sleeve to act so that the liquids with which the sleeve will then be filled are prevented from leaking out in the vapour or liquid phase through the sleeve walls. A sleeve manufactured according to the above method and device has a number of application areas.

Figure 6:
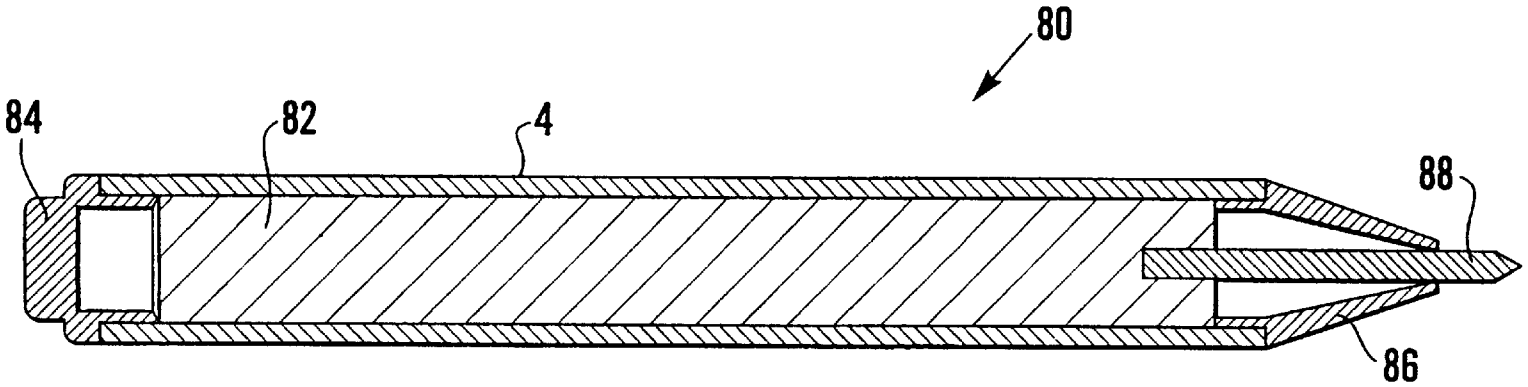
FIG. 6 shows an example of a product which comprises sleeves manufactured using the device according to FIG. 1

An example is shown in FIG. 6, in which the sleeve is used as a body for marker pens 80 and the like filled with colouring liquid. These are often constructed so that a body 82 of absorbent, tampon-like material is arranged in the sleeve, ink or another dye is put into the sleeve and absorbed by the body and its ends are sealed with plugs 84, 86, one plug being fitted with a writing tip 88 which extends into the body.

Figure 7:
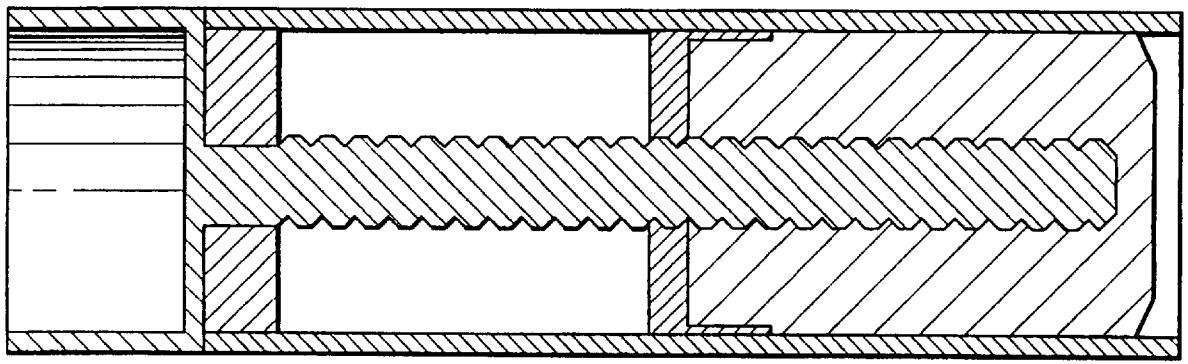
FIG. 7 shows another example of a product.

Another example is shown in FIG. 7, in which the coated sleeve is used as a shell in a glue stick.

By coating the inside of the sleeve with a suitable fluid, cardboard can be used as a material. Previously it was necessary to use plastic or metal to prevent the liquid from leaking out. Due to this design, the use of metal is avoided and the share of plastic is reduced considerably, which makes a marker pen manufactured using paper sleeves according to the present method a more environmentally friendly alternative. At the same time, due to the fact that only the inside of the sleeve is coated, it is entirely possible to print, apply labels to or colour the outside of the sleeve in order to provide the outside of the product with suitable information or give the product an attractive appearance as desired.

It is to be understood that the invention is not restricted to the embodiment described above and shown in the drawings, but can be modified within the scope of the following claims.

What is claimed is:

1. A method for manufacturing coated sleeves, comprising the steps of:

(a) positioning the sleeve vertically and holding it stationary;

(b) introducing a feed pipe from below, by vertical displacement, concentrically into said sleeve;

(c) supplying an excess of fluid under pressure, from below, through said feed pipe;

(d) allowing said fluid to emanate from an upper end outlet of said feed pipe;

(e) allowing said emanating fluid to flow by gravity into a small gap which is formed between said feed pipe and internal walls of the sleeve, whereby said internal walls of the sleeve are coated with the fluid at the same time as coating of an outside of the sleeve is prevented; and (f) turning the sleeve 180° about an horizontal axis, during draining of the fluid.

2. The method according to claim 1, comprising the additional step of, between steps (a) and (b), sealing the outside of the sleeve from an inside of the sleeve, by providing seals at an upper and lower end of said sleeve, respectively.

3. The method according to claim 1, wherein steps (b) through (e) are performed by supplying said fluid, allowing it to emanate and allowing the emanating fluid to flow down the gap, while the feed pipe is displace from a lower end of the sleeve, to an upper end of the sleeve.

4. The method according to claim 1, comprising the additional step (g), after step (e) and before step (f), of stopping the supply of fluid and holding the sleeve still in its vertical position for a certain time, in order to permit drying/solidification of the fluid on the internal walls of the sleeve, while retracting the feed pipe.

5. The method according to claim 1, wherein the sleeve is manufactured from renewable material.

6. The method according to claim 5, wherein the sleeve is manufactured from a material containing cellulose.

7. The method according to claim 6, wherein said fluid comprises wax or paraffin or a mixture thereof.

8. A device for manufacturing coated sleeves, comprising:

holding means for holding the sleeve stationary and positioned vertically;

a feed pipe, which is vertically arranged, below said holding means, operatively connected to a supply of fluid, at a lower end of the feed pipe, and provided with an upper end outlet;

displacing means for displacing said feed pipe vertically into said sleeve, from below;

supplying means for supplying an excess of said fluid under pressure; and turning means for turning the sleeve 180° about an horizontal axis, when the feed pipe is in its position below said holding means.

9. The device according to claim 8, wherein said feed pipe has an outer diameter which is smaller than an inner diameter of the sleeve, in order to provide a small gap between them, where the fluid is arranged to flow down by gravity in order to coat the internal walls of the sleeve.

10. The device according to claim 8, further comprising sealing means for sealing an inside of the sleeve from an outside of the sleeve, comprising seals to be arranged vertically above one another at an upper and lower end of said sleeve, respectively, in order to prevent fluid from being coated onto the outside of the sleeve and onto an upper and lower end surface of the sleeve, respectively.

11. The device according to claim 10, wherein said holding means comprises said sealing means, whereby a lower holding means is provided with a passage, arranged concentrically above the feed pipe and formed to hold the lower end of the sleeve detachably at the same time as it seals the lower end surface of the sleeve, and whereby an upper holding means, comprising sealing means for the upper end surface of the sleeve, is arranged concentrically above the lower holding means and arranged to be vertically displaced towards and away from the lower holding means.

12. The device according to claim 8, wherein said supplying means are arranged to operate during upward vertical displacement of the feed pipe into the sleeve, and to stop the supply of fluid when the feed pipe has reached an upper end of the sleeve.

13. The device according to claim 12, wherein said holding means are arranged to hold the sleeve still, in its vertical position, for a certain time after the supply of fluid has been stopped, in order to permit drying/solidification of the fluid on the internal walls of the sleeve, and wherein the displacing means are arranged to retract the feed pipe from the sleeve at the same time.

14. The device according to claim 8, wherein said turning means comprises gripping means for gripping the sleeve, and turning the same.

15. The device according to claim 8, wherein said turning means also are arranged to remove the finished, coated sleeve from the device.

16. The device according to claim 8, wherein said fluid comprises wax or paraffin or a mixture thereof.

17. The device according to claim 16, wherein said supply of fluid comprises a heating device for keeping the wax and/or paraffin in a liquid state.

* * * * *